US009002237B2

(12) United States Patent
McGuire et al.

(10) Patent No.: US 9,002,237 B2
(45) Date of Patent: Apr. 7, 2015

(54) ELECTROSTATIC IMAGING MEMBER AND METHODS FOR USING THE SAME

(75) Inventors: Gregory McGuire, Oakville (CA); Yu Liu, Mississuaga (CA); Richard A. Klenkler, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/182,346

(22) Filed: Jul. 13, 2011

(65) Prior Publication Data

US 2013/0017477 A1 Jan. 17, 2013

(51) Int. Cl.

| | |
|---|---|
| ***G03G 15/02*** | (2006.01) |
| ***G03G 5/026*** | (2006.01) |
| ***G03G 5/028*** | (2006.01) |
| ***G03G 5/04*** | (2006.01) |
| ***G03G 5/047*** | (2006.01) |
| ***G03G 5/06*** | (2006.01) |

(52) U.S. Cl.

CPC ..... *G03G 15/0216* (2013.01); *G03G 15/0291* (2013.01); *G03G 5/026* (2013.01); *G03G 5/028* (2013.01); *G03G 5/04* (2013.01); *G03G 5/047* (2013.01); *G03G 5/0614* (2013.01); *G03G 2215/00957* (2013.01)

(58) Field of Classification Search

CPC ..... G03G 15/0216; G03G 15/0291
USPC ..... 399/159, 176, 171, 170
See application file for complete search history.

(56) References Cited

U.S. PATENT DOCUMENTS

| | | | | | |
|---|---|---|---|---|---|
| 3,704,121 | A | * | 11/1972 | Makino et al. | 430/54 |
| 3,795,513 | A | * | 3/1974 | Ciuffini | 430/51 |
| 3,909,254 | A | * | 9/1975 | Tamai et al. | 430/97 |
| 3,997,342 | A | * | 12/1976 | Bailey | 430/58.6 |
| 4,329,413 | A | * | 5/1982 | Kitamura et al. | 430/54 |
| 4,444,860 | A | * | 4/1984 | Yasujima et al. | 430/58.6 |
| 4,464,450 | A | | 8/1984 | Teuscher | |
| 4,532,197 | A | * | 7/1985 | Humberstone et al. | 430/41 |
| 4,898,797 | A | * | 2/1990 | Gruenbaum et al. | 430/51 |
| 4,910,555 | A | * | 3/1990 | Namikawa et al. | 399/48 |
| 4,921,773 | A | | 5/1990 | Melnyk et al. | |
| 5,215,839 | A | | 6/1993 | Yu | |
| 5,240,800 | A | * | 8/1993 | Contois et al. | 430/51 |
| 5,660,961 | A | | 8/1997 | Yu | |

(Continued)

FOREIGN PATENT DOCUMENTS

| | | | |
|---|---|---|---|
| EP | 1 918 779 | A1 | 5/2008 |
| GB | 1380737 | A * | 1/1975 |

(Continued)

OTHER PUBLICATIONS

Owen, David. Copies in Seconds. New York: Simon and Schuster Paperbacks. (2004) pp. 166-175.*

(Continued)

*Primary Examiner* — Christopher Rodee

(74) *Attorney, Agent, or Firm* — Pillsbury Winthrop Shaw Pittman LLP

(57) ABSTRACT

Embodiments pertain to a novel imaging member, namely, an electrostatic latent image generating member, and methods for using the same, that can generate an electrostatic latent image through charge acceptance control and without the need for conventional post charging photodischarge, eliminating process steps and avoiding limitations in system speed due to the transit time of charge carriers after light exposure.

10 Claims, 5 Drawing Sheets

(56) References Cited

U.S. PATENT DOCUMENTS

| | | | | |
|---|---|---|---|---|
| 5,958,638 | A | 9/1999 | Katayama et al. | |
| 7,920,810 | B2 * | 4/2011 | Oron et al. | 399/156 |
| 2008/0102388 | A1 * | 5/2008 | Aziz et al. | 430/48 |
| 2008/0280222 | A1 * | 11/2008 | Belknap et al. | 430/58.8 |
| 2008/0299474 | A1 | 12/2008 | McGuire et al. | |
| 2008/0318146 | A1 * | 12/2008 | Belknap et al. | 430/58.8 |
| 2009/0061335 | A1 * | 3/2009 | Belknap et al. | 430/58.5 |
| 2009/0162637 | A1 | 6/2009 | Grabowski et al. | |
| 2009/0197196 | A1 * | 8/2009 | McGuire et al. | 430/133 |
| 2009/0233197 | A1 * | 9/2009 | Heuft et al. | 430/58.35 |
| 2010/0266940 | A1 * | 10/2010 | McGuire et al. | 430/58.8 |

FOREIGN PATENT DOCUMENTS

| | | | |
|---|---|---|---|
| JP | 55113064 | A * | 9/1980 |
| JP | 56147158 | A * | 11/1981 |
| JP | 62206565 | A * | 9/1987 |

OTHER PUBLICATIONS

English language translation of JP 56-147158 (Nov. 1981).*

U.S. Appl. No. 12/887,434, filed Sep. 21, 2010 to Klenkler et al.

* cited by examiner

ELECTROSTATIC IMAGING MEMBER AND METHODS FOR USING THE SAME

BACKGROUND

The presently disclosed embodiments pertain to a novel imaging member, namely, an electrostatic latent image generating member that can generate an electrostatic latent image through a single step charging process. The embodiments provide a novel way of generating an electrostatic latent image without the need for a photodischarge period that limits the speed with which the image forming apparatus can operate and limits the geometry of the image forming apparatus.

In conventional electrophotographic printing, the charge retentive surface, typically known as a photoreceptor, is electrostatically charged, and then exposed to a light pattern of an original image to selectively photodischarge the surface in accordance therewith. This photodischarge step takes a period of time determined by the transit time of the charge carriers and the required reduction in surface potential. This time is referred to as the photodischarge period. After the photodischarge period, the resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

Thus, it can be seen that current xerographic printing involves multiple steps, such as, charging the photoreceptor; selectively exposing the photoreceptor to light to induce photodischarge, allowing time for photodischarge to occur to create a latent image; developing the latent images, transferring and fusing the developed images; and, erasing and cleaning the photoreceptor. This sequence of steps limits the geometry and space which in turn limits the compactness of the system. Future trends in the industry are focusing on using machines that are smaller and faster. Thus, there is a need to re-design engine architecture to achieve machines that are less limited in compactness, such as for example, a printing apparatus that can create the latent image in a single step during charging.

Moreover, in conventional xerography the transit time of charge carriers after light exposure also limits the speed at which the system can operate. As system speed is increased the time available for photodischarge is reduced and the surface potential reduction is therefore also reduced. To address this issue, new hole transport molecules and imaging member layer designs have been used to reduce the discharge time. However, even the fastest of the newer molecules and designs are limited by the inherent low field transit time after light exposure. To overcome this limitation, it was proposed to eliminate the discharge step altogether and produce a latent image in a single charging step. U.S. patent Ser. No. 12/887,434 to Klenkler et al., filed Sep. 21, 2010 discloses an imaging member that allows for the latent image to be created during the charging process through use of digitally addressable metallic pads arranged as pixels, sandwiched between a thin-film transistor (TFT) backplane and a thin dielectric surface layer, where each pixel pad can individually be selectively isolated or connected to ground through the transistor backplane. A latent electrostatic image can be created on the dielectric surface of the imaging member by selectively grounding the pixel pads in an imagewise fashion while exposing the dielectric surface of the device to a corona source, such as a corotron. The ionized corona gas will be selectively electrostatically attracted to the grounded pixels under the dielectric layer. Thus, the charge acceptance under the scorotron is selectively controlled via the energized backplane. However, such embodiments are complex and thus there remains a desire to achieve a more simpler design that also provides high speed xerography.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule" or "electron transport molecules."

SUMMARY

According to aspects illustrated herein, there is provided a method for creating an electrostatic latent image, comprising: providing an electrostatic imaging member, further comprising a substrate, a charge generation layer disposed on the substrate, and a charge transport layer comprising a charge transport molecule disposed on the charge generation layer, wherein the electrostatic imaging member is light-sensitive; selectively exposing a surface of the electrostatic imaging member to light; and charging the surface of the electrostatic imaging member, wherein charge is not accepted by the exposed surface of the electrostatic imaging member and the charge is accepted by the unexposed surface of the electrostatic imaging member. As used herein, "light-sensitive" means that the absorption of light causes the excitation of an electron in the material absorbing the light to a high energy state, allowing for the transport of electrons in the material, which can be measured as an increase in current flow through the matter that will increase or decrease relative to the intensity and wavelength of the light.

In another embodiment, there is provided an electrostatic imaging device, comprising: an electrostatic imaging member comprising a substrate, a charge generation layer disposed on the substrate, and a charge transport layer comprising a charge transport molecule disposed on the charge generation layer, wherein electrostatic imaging member is light-sensitive; an exposing device for selectively exposing a surface of the electrostatic imaging member to light; and an electrostatic charging device for charging the surface of the electrostatic imaging member, wherein charge is not accepted by the exposed surface of the electrostatic imaging member and the charge is accepted by the unexposed surface of the electrostatic imaging member.

Yet another embodiment, there is provided an image forming apparatus for forming images on a recording medium comprising: a) an electrostatic imaging device having a charge retentive-surface for receiving an electrostatic latent image thereon, wherein the electrostatic imaging device comprises an electrostatic imaging member comprising a substrate, a charge generation layer disposed on the substrate, and a charge transport layer comprising a charge transport molecule disposed on the charge generation layer, wherein electrostatic imaging member is light-sensitive; an exposing device for selectively exposing a surface of the electrostatic imaging member to light; and an electrostatic charging device for charging the surface of the electrostatic imaging member, wherein charge is not accepted by the exposed surface of the electrostatic imaging member and the charge is accepted by the unexposed surface of the electrostatic imaging member; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
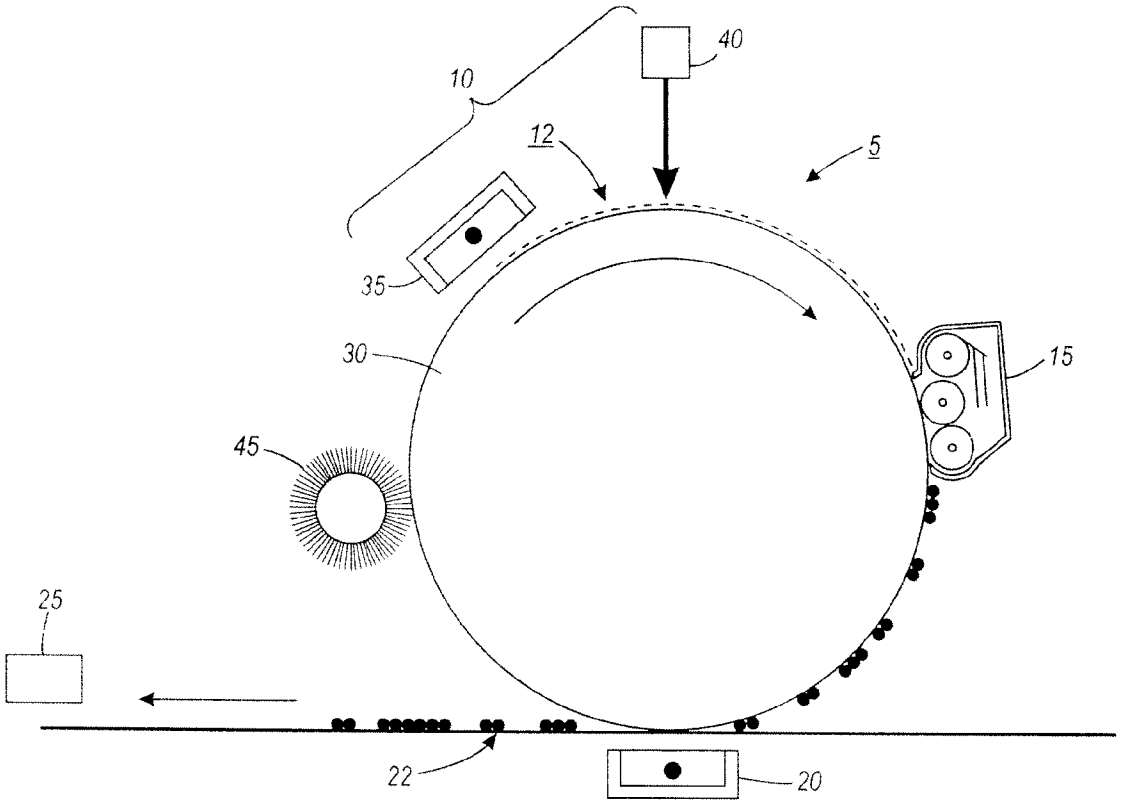
FIG. 1 is a cross-section of a conventional imaging member.

In the following description, reference is made to the accompanying drawings, which form a part hereof and which illustrate several embodiments. It is understood that other embodiments may be used and structural and operational changes may be made without departure from the scope of the present disclosure.

There are disadvantages of the conventional photoreceptor-based xerographic process which include limited charge mobility (and therefore limited system response time and printing speed), and the need for a photodischarge period that does not limit system compactness. Several solutions to these issues have been proposed through the years but these have not been able to entirely resolve the issues.

The present embodiments provide an electrostatic imaging device that comprises an exposure device, such as a laser raster output scanner (ROS) or light-emitting diode (LED) array that precedes the charging step, and a photoreceptor in which the charge acceptance can be controlled using the ROS. The combination provides a selective exposure of the photoreceptor before undergoing charging from, for example, a corotron, scorotron or biased charge roller. The light sensitive charge acceptance of the photoreceptor produces a latent image without the need for conventional post charging photodischarge, eliminating the need for a photodischarge period and avoiding limitations in system compactness and speed due to the transit time of charge carriers after light exposure. As such, the present embodiments provide a simple design which also allows for compact, high speed xerography not achieved by prior devices.

In the present embodiments, the charge acceptance of the photoreceptor is controlled by using a hole transport molecule that when incorporated into a photoreceptor demonstrates light sensitive charge acceptance, and thus, control of the charge acceptance is possible via pre-exposing the imaging member to light. By using an addressable exposure device preceding the charging step, the latent image can be formed entirely within the charging step and not require waiting for the holes to reach the surface of the charge transport layer. Areas that are exposed to light do not accept the charge supplied by the charge device and provides an image voltage sufficient to support development. Areas that are not exposed prior to charging, accept the ions from the charge device and charge-up to a useable background potential. Moreover, image voltage gets lower as the speed increases, thus facilitating high speed xerography. The latent image is formed entirely during the charging step and eliminates the need for time between expose and development steps.

The present embodiments thus provide a method for creating an electrostatic latent image which comprises providing an electrostatic imaging member, selectively exposing a surface of the electrostatic imaging member to light, and charging the surface of the electrostatic imaging member, wherein charge is not accepted by the exposed surface of the electrostatic imaging member and an electrostatic image is generated in a single charging step. In such embodiments, the electrostatic imaging member comprises a substrate, a charge generation layer disposed on the substrate, and a charge transport layer disposed on the charge generation layer, wherein the charge transport layer comprises a charge transport molecule.

FIG. 1 illustrates a conventional xerographic image-forming apparatus 5 in which the electrostatic latent image is formed via photodischarge after scorotron charging. As seen, the conventional image-forming apparatus 5 comprises an electrostatic imaging device 10 having a charge retentive-surface 12 for receiving an electrostatic latent image thereon, a development component 15 for applying a developer material to the charge-retentive surface 12 to develop the electrostatic latent image to form a developed image on the charge-retentive surface 12, a transfer component 20 for transferring the developed image from the charge-retentive surface 12 to a copy substrate 22, and a fusing component 25 for fusing the developed image to the copy substrate 22.

The electrostatic imaging device comprises an imaging member 30, an electrostatic charging device 35 for charging the surface of the electrostatic imaging member and an exposing device 40 for exposing the surface of the electrostatic imaging member 30 to light. In FIG. 1, the charge retentive surface 12 of the electrostatic imaging member 30 must be charged and then discharged to form an electrostatic charge pattern, known as a latent image, conforming to the original image. The latent image is developed by contacting it with a finely divided electrostatically attractable powder known as toner. Toner is held on the image areas by the electrostatic charge on the imaging member surface. The toner image may then be transferred to a substrate or support member (e.g., paper) directly or through the use of an intermediate transfer member 20, and the image affixed thereto to form a permanent record of the image to be reproduced or printed. Subsequent to development, excess toner left on the charge retentive surface is cleaned from the surface 12 by, for example, a cleaning brush 45.

Figure 2:
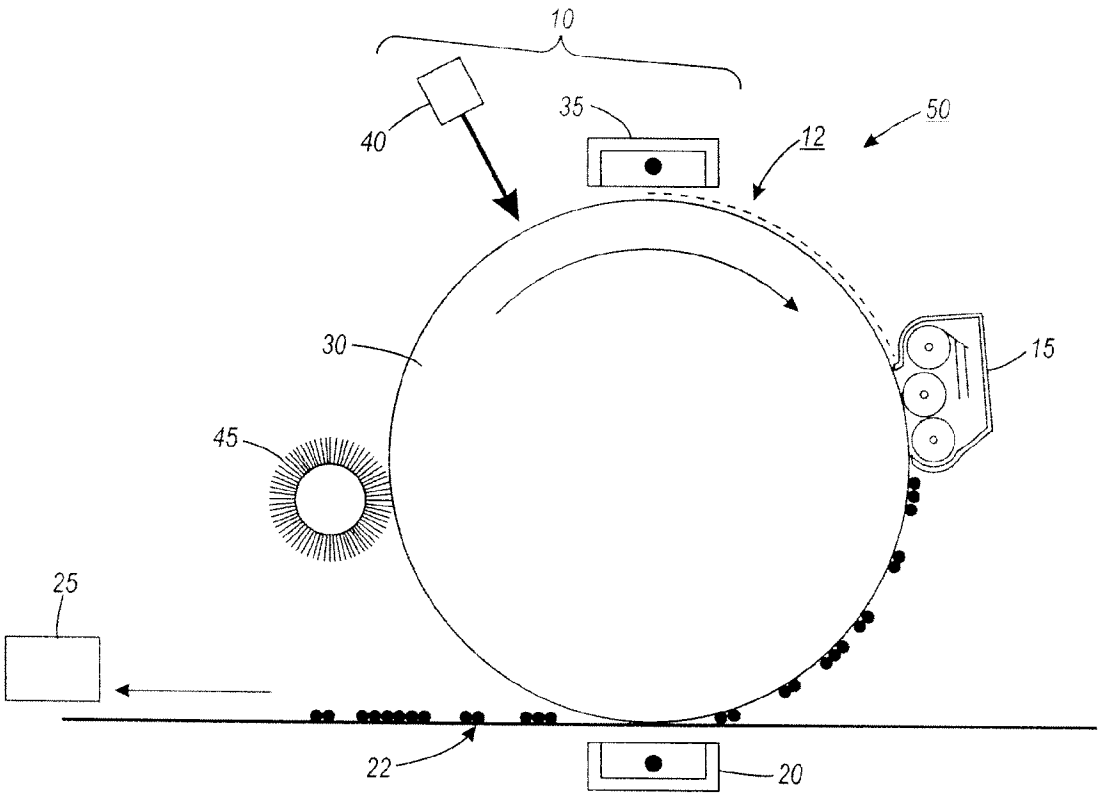
FIG. 2 is a cross-section of an electrostatic latent imaging member according to the present embodiments.

FIG. 2 illustrates a xerographic image-forming apparatus 50 in accordance with the present embodiments. As seen, the image-forming apparatus 50 of the present embodiments has similar components and structure as the conventional image-forming apparatus except that the exposing device 40 and the electrostatic charging device 35 in the electrostatic imaging device 10 are positioned in reverse order as compared to that found in the conventional image-forming apparatus 5. In such embodiments, the latent image is formed during charging. Charge acceptance is controlled by using a charge or hole transport molecule that has variable charge acceptance dependent on light exposure and selectively pre-exposing the imaging member to light before surface charging. Because the charge is not accepted by the selectively exposed surface of the electrostatic imaging member, an electrostatic image can be generated in a single charging step. Thus, by using charge acceptance control rather than convention photodischarge, the process is not limited by photodischarge time. In these embodiments, the exposing device provides a light having an intensity of from about 100 ergs/$cm^2$ to about 5000 ergs/$cm^2$, or from about 1000 ergs/$cm^2$ to about 3000 ergs/$cm^2$. In these embodiments, the exposing device is selected from the group consisting of a laser raster output scanner (ROS) and a light-emitting diode (LED) array. The electrostatic charger may be selected from the group consisting of a corotron, scorotron and biased charge roller.

In the present embodiments, the imaging member comprises a substrate, a charge generation layer disposed on the substrate, and a charge transport layer disposed on the charge generation layer, wherein the charge transport layer comprises a charge transport molecule. In particular embodiments, the charge transport molecule is N,N,N',N'-tetra(4-methylphenyl)-(1,1'-biphenyl)-4,4'-diamine.

The charge transport layer may also include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer and capable of allowing the transport of these holes through the charge transport layer in order to discharge the surface charge on the charge transport layer. The high mobility charge transport component may comprise small molecules of an organic compound which cooperate to transport charge between molecules and ultimately to the surface of the charge transport layer.

Examples of charge transport components are aryl amines of the following formulas/structures:

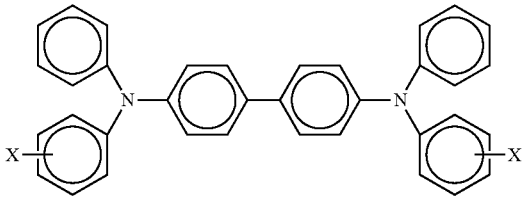

and

-continued

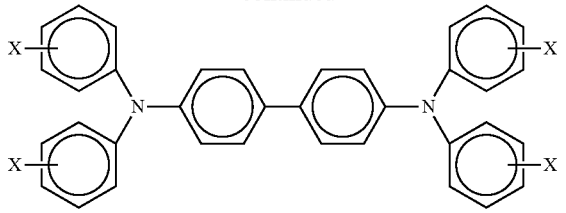

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

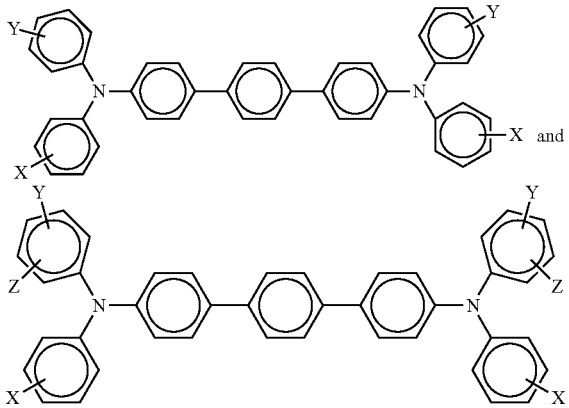

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

One specific suitable charge transport material is N,N,N'N'-tetra(4-methylphenyl)-(1,1'-biphenyl)-4,4'-diamine, of the formula

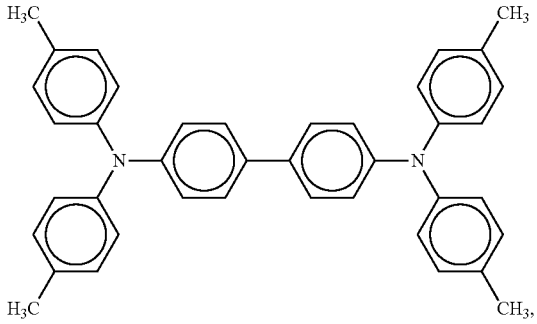

as disclosed in, for example, U.S. Patent Publication 2008/0102388, U.S. Patent Publication No. 2008/0299474, and European Patent Publication EP 1 918 779 A1, the disclosures of each of which are totally incorporated herein by reference.

Examples of specific aryl amines that can be selected for the charge transport layer include, but not limited to, N,N'-diphenyl-N,N-bis(3-methyl phenyl)-1,1'-biphenyl-4,4'-diamine (TPD); N,N,N',N'-tetra-p-tolyl-1,1'-biphenyl-4,4'-diamine (TM-TPD); N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"-diamine; N,N'-bis(4-butylphenyl)-N,N'-bis-(2-ethyl-6-methylphenyl)-[p-terphenyl]-4,4"-diamine; N,N'-bis(4-butylphenyl)-N,N'-bis-(2,5-dimethylphenyl)-[p-terphenyl]-4,4'-diamine; N,N'-diphenyl-N,N'-bis(3-chlorophenyl)-[p-terphenyl]-4,4"-diamine; and the like. Other known charge transport layer molecules may be selected in embodiments, reference for example, U.S. Pat. Nos. 4,921,773 and 4,464,450, the disclosures of which are totally incorporated herein by reference.

In the present embodiments, the charge transport molecule is present in the charge transport layer in an amount of from about 1% to about 60%, or from about 30% to about 50% percent weight of the total weight of the charge transport layer. The charge transport layer may have a thickness of from about 2 microns to about 40 microns, or from about 20 microns to about 30 microns.

The present embodiments provide various advantages over the conventional photoreceptor-based system. In particular, the formation of electrostatic images is free from a post charging photo-induced discharge period and charge transport that are inherent with photoreceptor designs. This enables high speed operation and compact design due to simultaneous charging and latent image formation rather than imaging via photo-discharge.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limiting examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Example 1

Prototype Fabrication

Figure 3:
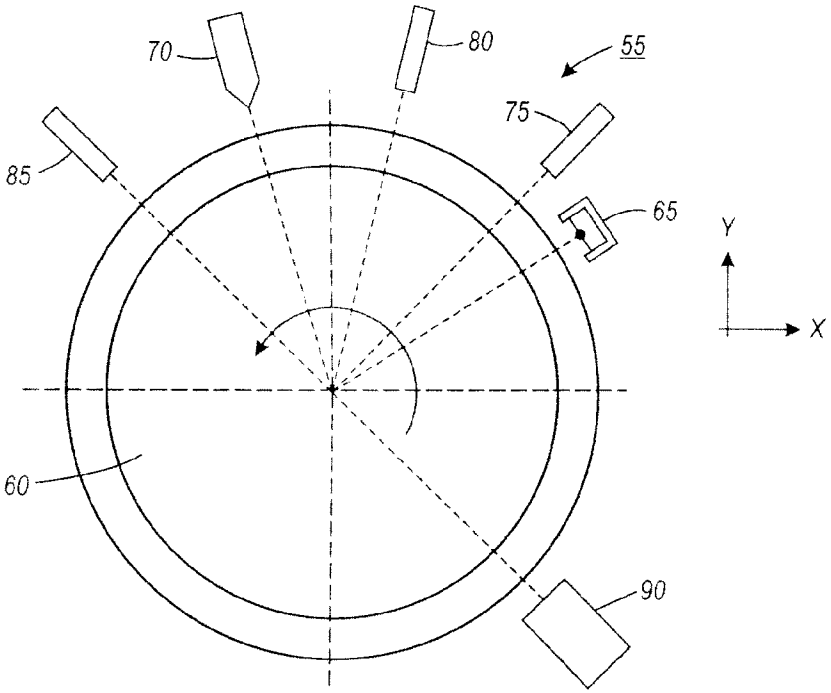
FIG. 3 is a xerographic scanner for conducting electrical measurement and ghosting experiments.

An electrical test fixture 55 was fabricated using an 84-mm drum scanner 60, as shown in FIG. 3. The charging device 65 was a scorotron and the exposing device 90 was an 630 nm LED line scan illuminator. The erase lamp 70 was a Xenon Lamp filtered to 780 nm. The exposure system was placed before the scorotron and the erase lamp was placed after electrostatic voltmeters (ESV), labeled ESV1 (75) and ESV2 (80). ESV3 (85) was located after the erase lamp. The test fixture 55 is capable of a maximum speed of 240 RPM which produces the following timings (Table 1):

TABLE 1

| Timings | |
|---|---|
| High intensity exposure | 0 ms |
| Scorotron | 45 ms |
| ESV1 | 75 ms |
| ESV2 | 92 ms |
| Erase lamp | 108 ms |
| ESV3 | 141 ms |

Photoreceptor Fabrication

An imaging member was prepared in accordance with the following procedure. A metallized MYLAR substrate was provided and a hydroxygallium phthalocyanine (HOGaPc)/poly(bisphenol-Z carbonate) photogenerating layer was machine coated over the substrate. A charge transport layer was prepared by introducing into an amber glass bottle 50 weight percent of high quality N,N,N'N'-tetra(4-methylphenyl)-(1,1'-biphenyl)-4,4'-diamine (Compound 1), and 50 weight percent of a polymer binder, FPC-0170 polymer (available from Mitsubishi Gas Chemical Co.). As disclosed in U.S. Patent Publication No. 2009/0162637, which is hereby incorporated by reference, FPC-0170 is a polycarbonate polymer based on 98 percent bisphenol A and 2 percent bisphenol Z and has a measured molecular weight range of 60,000 to 70,000 (as measured by auto capillary viscometer).

The resulting mixture was then dissolved in methylene chloride to form a solution containing 15 percent by weight solids. This solution was applied on the photogenerating layer to form a layer coating that upon drying (at 120° C. for 1 minute) had a thickness of 30 microns. The imaging member was then mounted onto a 84-mm diameter bare aluminum drum and grounded.

Testing Method

Figure 4:
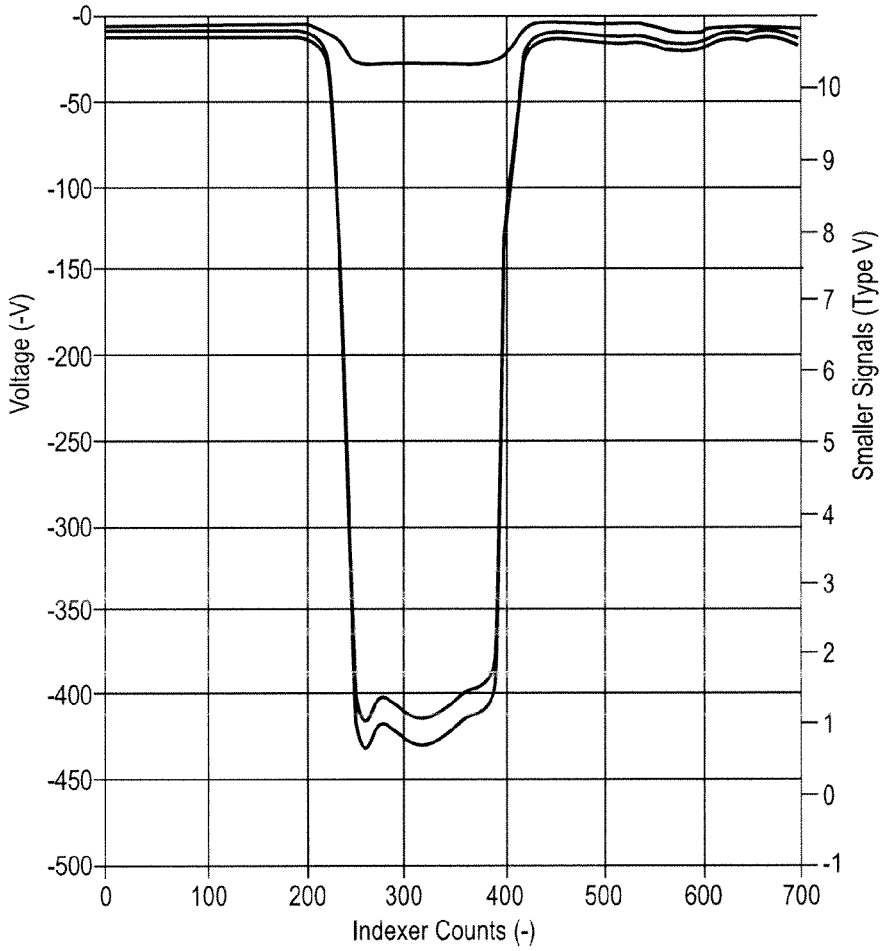
FIGS. 4 and 5 are graphs illustrating charge acceptance with and without pre-exposure.
Figure 5:
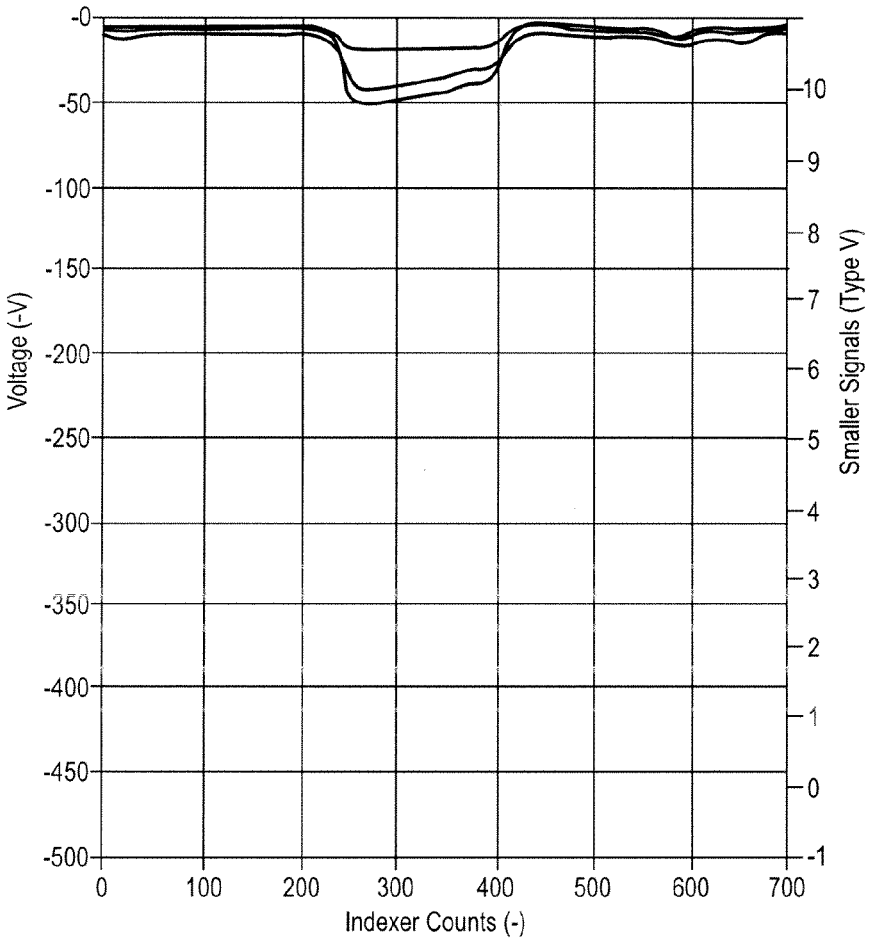

Using the above measurement system, the photoreceptor was mounted and the exposure line scanner energy was set to 3.9 ma as measured by a photodiode for the "on-state," as shown in FIG. 4, and 0 ma as measured by photodiode for the "off-state," as shown in FIG. 5. This setting provided 3000 erg/cm$^2$ of 630 nm light to the photoreceptor for the "on-state". The speed of the drum was set to 240 RPM. Next, the charge acceptance (as ESV1 and ESV2 in FIG. 3) was measured for both the on and off states.

RESULTS

The off-state produces very high charge acceptance (about 450 V), equivalent to the charged state in conventional discharge area development (DAD) xerography (FIG. 4). The on-state produces very low charge acceptance (about 40 V), equivalent to the discharged state in conventional DAD xerography (FIG. 5).

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An image forming apparatus for forming images on a recording medium comprising:

a) an electrostatic imaging device having a charge retentive-surface for receiving an electrostatic latent image thereon, wherein the electrostatic imaging device comprises an electrostatic imaging member comprising a substrate, a charge generation layer disposed on the substrate, and a charge transport layer comprising a charge transport molecule disposed on the charge generation layer, wherein electrostatic imaging member is light-sensitive;

wherein the charge transport molecule is selected from the group consisting of

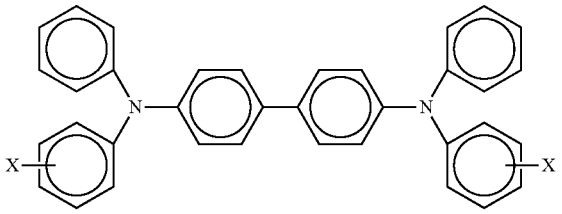

wherein X is an alkyl, alkoxy, aryl, a halogen, and mixtures thereof;

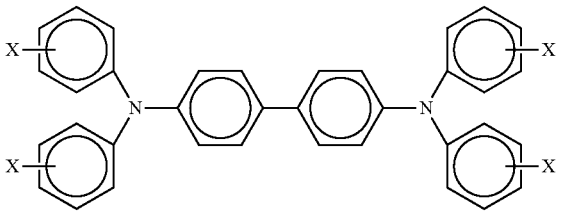

wherein X is an alkyl, alkoxy, aryl, a halogen, and mixtures thereof;

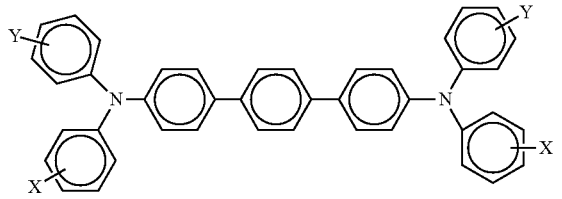

wherein X, Y and Z are independently alkyl, alkoxy, aryl, a halogen, or mixtures thereof, and wherein at least one of Y and Z are present;

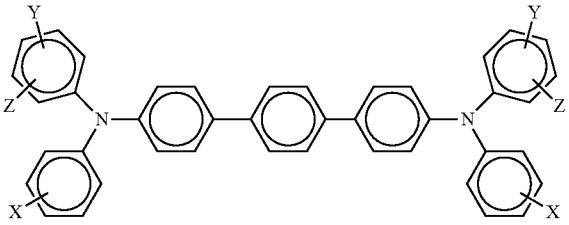

wherein X, Y and Z are independently alkyl, alkoxy, aryl, a halogen, or mixtures thereof, and wherein at least one of Y and Z are present; and mixtures thereof;

a single exposing device for selectively exposing a surface of the electrostatic imaging member to light; and a single electrostatic charging device for charging the surface of the electrostatic imaging member, wherein charge is not accepted by the exposed surface of the electrostatic imaging member and the charge is accepted by the unexposed surface of the electrostatic imaging member, further wherein the exposing device is located before the electrostatic charging device such that the exposing the surface of the electrostatic imaging member to light precedes the charging the surface of the electrostatic imaging member;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate;

wherein the electrostatic charging device is located between the exposing device and the development component.

2. The image forming apparatus of claim 1, wherein the charge transport molecule is present in the charge transport layer in an amount of from about 30% to about 50%.

3. The image forming apparatus of claim 1, wherein the charge transport molecule further comprises a polymer binder.

4. The image forming apparatus of claim 1, wherein the charge transport layer has a thickness of from about 2 microns to about 40 microns.

5. The image forming apparatus of claim 1, wherein the charge transport layer has a thickness of from about 20 microns to about 30 microns.

6. The image forming apparatus of claim 1, wherein the charge transport molecule comprises N,N,N',N'-tetra(4-methylphenyl)-(1,1'-biphenyl)-4,4'-diamine.

7. The image forming apparatus of claim 1, wherein the charge transport molecule is present in the charge transport layer in an amount of from about 1% to about 60%.

8. The image forming apparatus of claim 1, wherein the exposing device is selected from the group consisting of a raster output scanner (ROS) and light-emitting diode (LED) array.

9. The image forming apparatus of claim 1, wherein the electrostatic charging device is selected from the group consisting of a corotron, scorotron and biased charge roller.

10. An image forming apparatus for forming images on a recording medium comprising:

a) an electrostatic imaging device having a charge retentive-surface for receiving an electrostatic latent image thereon, wherein the electrostatic imaging device comprises an electrostatic imaging member comprising a substrate, a charge generation layer disposed on the substrate, and a charge transport layer comprising a charge transport molecule disposed on the charge generation layer, wherein electrostatic imaging member is light-sensitive;

wherein the charge transport molecule is selected from the group consisting of

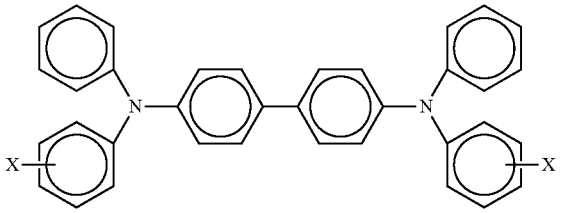

wherein X is an alkyl, alkoxy, aryl, a halogen, and mixtures thereof;

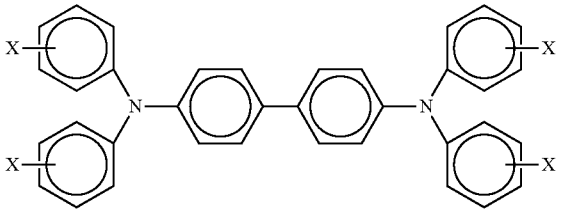

wherein X is an alkyl, alkoxy, aryl, a halogen, and mixtures thereof;

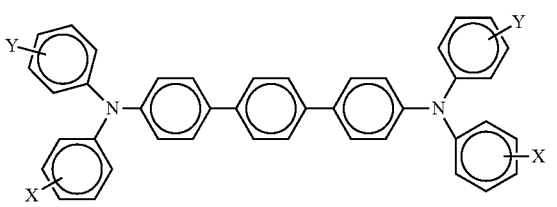

wherein X, Y and Z are independently alkyl, alkoxy, aryl, a halogen, or mixtures thereof, and wherein at least one of Y and Z are present;

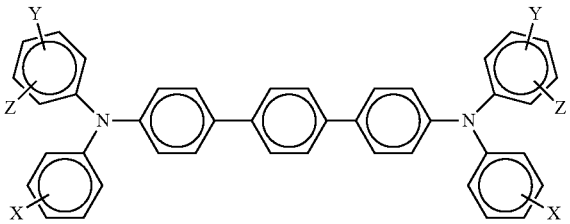

wherein X, Y and Z are independently alkyl, alkoxy, aryl, a halogen, or mixtures thereof, and wherein at least one of Y and Z are present; and mixtures thereof;

an exposing device for selectively exposing a surface of the electrostatic imaging member to light; and an electrostatic charging device for charging the surface of the electrostatic imaging member;

wherein charge is not accepted by the exposed surface of the electrostatic imaging member and the charge is accepted by the unexposed surface of the electrostatic imaging member, wherein the exposing device is located before the electrostatic charging device such that the exposing the surface of the electrostatic imaging member to light precedes the charging the surface of the electrostatic imaging member, further wherein the electrostatic charging device is the only charging device present in the electrostatic imaging device and no other electrostatic charging device is located before the exposing device;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate;

wherein the electrostatic charging device is located between the exposing device and the development component.

* * * * *